US008237644B2

(12) United States Patent
Morvan et al.

(10) Patent No.: US 8,237,644 B2
(45) Date of Patent: Aug. 7, 2012

(54) DISPLAY DEVICE WITH LCOS VALVE OF REDUCED SIZE

(75) Inventors: Patrick Morvan, Laille (FR); Philippe Rio, Rennes (FR); Maurice Fritsch, Rennes (FR); Didier Doyen, La Bouexiere (FR)

(73) Assignee: Thomson Licensing, Issy-les-Moulineaux (FR)

( * ) Notice: Subject to any disclaimer, the term of this patent is extended or adjusted under 35 U.S.C. 154(b) by 958 days.

(21) Appl. No.: 10/589,930

(22) PCT Filed: Feb. 1, 2005

(86) PCT No.: PCT/EP2005/050439
§ 371 (c)(1),
(2), (4) Date: May 23, 2007

(87) PCT Pub. No.: WO2005/078695
PCT Pub. Date: Aug. 25, 2005

(65) Prior Publication Data

US 2007/0279348 A1 Dec. 6, 2007

(30) Foreign Application Priority Data

Feb. 18, 2004 (FR) ..... 04 01636

(51) Int. Cl.
*G09G 3/36* (2006.01)

(52) U.S. Cl. ..... 345/87; 345/90; 345/92; 345/98; 345/103

(58) Field of Classification Search ..... 345/87–110
See application file for complete search history.

(56) References Cited

U.S. PATENT DOCUMENTS

| | | | | |
|---|---|---|---|---|
| 5,333,004 | A * | 7/1994 | Mourey et al. | 345/92 |
| 5,926,158 | A * | 7/1999 | Yoneda et al. | 345/90 |
| 6,181,311 | B1 | 1/2001 | Hashimoto | |
| 6,476,785 | B1 * | 11/2002 | Pathak et al. | 345/90 |
| 6,525,710 | B1 * | 2/2003 | Kwon | 345/100 |
| 6,628,258 | B1 * | 9/2003 | Nakamura | 345/98 |
| 6,933,910 | B2 * | 8/2005 | Kodate et al. | 345/55 |

(Continued)

FOREIGN PATENT DOCUMENTS

EP 0631271 12/1994

(Continued)

OTHER PUBLICATIONS

Search Report Dated May 23, 2005.

*Primary Examiner* — Bipin Shalwala
*Assistant Examiner* — Matthew Fry
(74) *Attorney, Agent, or Firm* — Myers Wolin, LLC

(57) ABSTRACT

The present invention relates to the architecture of a valve of liquid crystal elements with pixel memory for front or rear projector. The valve comprises elements arranged in rows and columns, each of the elements comprising a liquid crystal controlled by drive means so as to display video information relating to at least one image. According to the invention, one seeks to reduce the size of the drive means of the liquid crystals. Accordingly, capacitors and transistors of the drive means are shared in common between several elements of the valve. The video information intended to be displayed by each of the elements of the valve is coded as a common value shared by a group of at least two adjacent elements of the valve and a specific value before being transmitted to the valve.

7 Claims, 7 Drawing Sheets

U.S. PATENT DOCUMENTS

| | | | | |
|---|---|---|---|---|
| 6,963,324 | B2 * | 11/2005 | Tsutsui et al. | 345/92 |
| 6,965,365 | B2 * | 11/2005 | Nakamura | 345/87 |
| 7,006,066 | B2 * | 2/2006 | Chen et al. | 345/90 |
| 7,425,940 | B2 * | 9/2008 | Kawachi | 345/98 |
| 7,847,773 | B2 * | 12/2010 | Chiang et al. | 345/93 |
| 2002/0060674 | A1 * | 5/2002 | Tsutsui et al. | 345/204 |
| 2003/0030609 | A1 | 2/2003 | Lee | |
| 2003/0090448 | A1 * | 5/2003 | Tsumura et al. | 345/87 |
| 2004/0041768 | A1 * | 3/2004 | Chen et al. | 345/90 |
| 2004/0155856 | A1 * | 8/2004 | Richards et al. | 345/102 |
| 2005/0200788 | A1 * | 9/2005 | Edwards | 349/139 |
| 2007/0252780 | A1 * | 11/2007 | Lebrun | 345/55 |
| 2009/0278827 | A1 * | 11/2009 | Yokoyama | 345/204 |

FOREIGN PATENT DOCUMENTS

| | | | |
|---|---|---|---|
| EP | 1207513 | | 5/2002 |
| FR | 2841366 | | 12/2003 |
| JP | 09-288261 | | 11/1997 |
| JP | 2000-227782 | | 8/2000 |
| JP | 2004-191574 | | 7/2004 |
| JP | 2004191574 | A * | 7/2004 |
| WO | WO2004001711 | | 12/2003 |

* cited by examiner

DISPLAY DEVICE WITH LCOS VALVE OF REDUCED SIZE

This application claims the benefit, under 35 U.S.C. §365 of International Application PCT/EP2005/050439, filed Feb. 1, 2005, which was published in accordance with PCT Article 21(2) on Aug. 25, 2005 in English and which claims the benefit of French patent application No. 0401636, filed Feb. 18, 2004.

The present invention relates to a display device of front or rear projector type comprising an LCOS (Liquid Crystal On Silicon) type valve.

It will be described within the framework of a sequential colour display although it may be applied to a monochrome display.

A conventional LCOS valve is an array of elements arranged in rows and columns, each element being intended to display an image pixel. Currently, the architecture of an LCOS valve may be of two types:

- an architecture without pixel memory in which the images received are directly displayed; each valve element comprises a transistor controlling a liquid crystal; the size of the valve is then reduced but it is not possible to address a valve element and to illuminate another element of the valve simultaneously; in a sequential colour display system using a colour wheel, the wheel must then comprise a black segment between each colour segment, thereby greatly reducing the luminous efficiency of the system.
- an architecture with pixel memory such as described in U.S. Pat. No. 6,476,785; FIG. 1 represents the functional diagram of a valve element of this type; this element, referenced 10, is capable of storing an item of video information before displaying it; it does not have the drawbacks of the previous architecture in the case of sequential colour display but, however, occupies a significant size on silicon; the present invention is more particularly concerned with this type of architecture.

With reference to FIG. 1, the element 10 is linked to a column line 11 of the valve to which are applied voltages representative of successive video levels to be displayed by the element as well as by the other elements of the valve belonging to the same column of elements. The element 10 comprises a liquid crystal 12 which reflects a quantity of light (provided by an external light source contained in the projector) proportional to the voltage applied to its input electrodes. The liquid crystal 12 conventionally comprises two electrodes. The first, commonly called the mirror electrode and denoted E in FIG. 1, receives the video voltage for the element 10. The second, denoted CE and called the counter-electrode, is held at a fixed or variable potential. The potential difference within the liquid crystal modulates the light reflected or transmitted by the liquid crystal. A drive circuit is inserted between the column line 11 and the mirror electrode of the liquid crystal 12. It comprises two storage capacitors CS1 and CS2 provided for storing voltage levels present on the column line 11 at different instants. Thus, while a voltage level applied to the column line 11 is stored in one of said capacitors, the voltage level stored in the other capacitor is applied to the mirror electrode of the liquid crystal 12. It is therefore possible to store a video level during the display of another level. The drive circuit more particularly comprises transistors T1, T2, T3 and T4 for connecting the storage capacitors CS1 and CS2 either to the column line 11, or to the mirror electrode of the liquid crystal 12. The transistor T1 is connected between the column line 11 and a first terminal of the capacitor CS1, the other terminal of the capacitor CS1 being connected to ground or to a low fixed potential. The transistor T1 is driven by the signal R(j)_A, j being the number of the row to which the element considered belongs. The transistor T2 is connected between the first terminal of the capacitor CS1 and the mirror electrode of the liquid crystal 12 and is driven by the signal READ_A. The transistor T3 is connected between the column line 11 and a first terminal of the capacitor CS2, the other terminal of the capacitor CS2 being connected to ground or to a low fixed potential. It is commanded by the signal R(j)_B. Finally, the transistor T4 is connected between the first terminal of the capacitor CS2 and the mirror electrode of the liquid crystal 12 and is driven by the signal READ_B.

The operation mode of this valve element is illustrated by FIGS. 2 to 4 in the case of a sequential colour display during a frame. Video information Ri (for the red colour), Gi (for the green colour) and Bi (for the colour blue) referring to an image i are provided sequentially on the column line 11. Represented in FIG. 2 are time charts showing the state of the transistors during writing to the element 10 and/or the illumination by the latter of the information B0, R1, G1, B1, B2 and G2 transmitted in this order on the column line 11 at regular intervals. Information (not represented) referring to other elements of the column is transmitted during these intervals. In a first phase of operation, when the information item R1 is present on the column line 11, the transistor T1 is turned on (R(j)_A=1) so as to store R1 in the capacitor CS1. Simultaneously, the transistor T4 (READ_B=1) is turned on so as to display the information item B0 stored previously in the capacitor CS2. Although the transistor T1 is quickly turned off again, the transistor T4 remains conducting until the information item G1 is present on the column line 11. The transistor T3 then turns on (R(j)_B=1) so as to store the information item G1 in the capacitor CS2. Simultaneously, the transistor T2 becomes conducting (READ_A=1) so that the liquid crystal 12 receives on its mirror electrode the information item R1 previously stored in the capacitor CS1. The transistor T2 remains conducting until the information item B1 appears on the column line 11. The transistor T then becomes conducting again so as to store the information item B1 in the capacitor CS1 and the above is repeated immediately. FIG. 3 illustrates the operation phase corresponding to the storing of the information item G1 and to the displaying of the information item R1 and FIG. 4 illustrates the operation phase corresponding to the storing of the information item B1 and to the displaying of the information item G1.

As mentioned previously, this architecture allows each element of the valve to receive and display simultaneously different video levels. Its main drawback is the large number of transistors in the drive circuit of the elements. The size of the drive circuit of each element of the valve is therefore large, this being prejudicial to the overall size of the valve.

Currently, with a 0.35 μm CMOS technology supporting voltage levels of the order of 3 to 5 volts necessary for the driving of the liquid crystals of the valve, the dimensions of each valve element are 12 μm×12 μm. In the case of a high-definition image (1920×1080), this represents a diagonal of 1.05 inches.

An object of the invention is to propose a new architecture of valve for reducing the dimensions of the latter and decreasing its manufacturing cost.

According to the invention, it is proposed to reduce the number of transistors and of capacitors in the drive circuit of the liquid crystals by sharing some of them in common between several elements of the valve.

The present invention relates to an image display device comprising:

- a valve of elements arranged in rows and columns, each of said elements comprising a liquid crystal one of whose electrodes, called the mirror electrode, is controlled by drive means so as to display video information relating to at least one image, means for coding, for each image, the video information intended to be displayed by each of the elements of the valve as a common value shared by a group of at least two adjacent elements of the valve and a specific value, and for transmitting them to said valve, the drive means consisting of:

for each element of the valve, a specific drive means coupled to the mirror electrode of the liquid crystal of said element and intended to store the specific value associated with the video information item to be displayed by said element and to apply it to the mirror electrode of the liquid crystal of said element and for each group of at least two elements of the valve, a common drive means coupled to each element of said group and intended to store said common value associated with the video information item to be displayed by said elements of the group and to apply it to the mirror electrode of the liquid crystals of the elements of said group, the specific drive means and the common drive means that are coupled to one and the same group of elements controlling the liquid crystals of the elements of the group in such a way as to alternately display the specific values and the common value of the video information relating to the elements of the group for an image.

In the case of a sequential colour display with at least two colours, the specific drive means and the common drive means that are coupled to one and the same group of elements control the liquid crystals of the elements of the group in such a way as to alternately display the specific values of the video information relating to a colour and the common values of the video information relating to said colour or to another colour.

In the case of a sequential colour display, the device then comprises for example:

a light source for producing white light and illuminating said valve of elements, said valve reflecting or allowing through a quantity of light as a function of the specific and common values that are transmitted to it by the coding means, and a colour wheel, interposed between said light source and said valve, comprising a colour segment for each of said at least two colours, said wheel being synchronized with the coding means so that, when specific or common values relating to a colour are applied to the mirror electrodes of the liquid crystals of the valve, the wheel segment corresponding to said colour filters the light produced by the source.

According to the invention, the adjacent elements of a group of elements may belong either to one and the same column of elements of the valve and to consecutive rows, or to consecutive rows and consecutive columns of elements of the valve.

According to the invention the specific drive means of an element comprises:

a first storage capacitor for storing the specific values present on a column line of the valve and intended for said element, a first switch for connecting the column line to a first end of said first storage capacitor, the other end being connected to a fixed potential, and a second switch for connecting the first end of the first storage capacitor to the mirror electrode of the liquid crystal of the element.

The common drive means of a group of elements of the valve comprises:

a second storage capacitor for storing the common value present on the column line of the valve and intended for said group, a third switch for connecting the column line to a first end of the second storage capacitor, the other end being connected to a fixed potential, and fourth switches for connecting the first end of the second storage capacitor to the mirror electrodes of the liquid crystals of the elements of the group.

The invention will be better understood on reading the description which follows, given by way of nonlimiting example, and with reference to the appended figures among which:

According to the invention, there is proposed a new architecture of valve elements making it possible to reduce the number of transistors and of capacitors in the valve. According to this architecture, transistors and capacitors are used in common by several elements of the valve to drive the liquid crystals of these elements. It is more particularly proposed that a single transistor T3 and a single capacitor CS2 be used in each group of at least two elements of the valve. Various embodiments are proposed to illustrate this principle.

This architecture requires the use of a particular coding of the video information and of a particular address of the video information coded in the valve. This particular coding consists in decomposing the video information of each image pixel into two parts: a value common to a group of at least two adjacent pixels and a value specific to each pixel. In order for the common values and the specific values to be displayed during one and the same video frame, the frequency of addressing of the elements of the valve is multiplied by two with respect to a conventional sequential colour display (180 Hz). According to the invention, the common value shared by a group of pixels is stored in the capacitor CS2 of the group of at least two valve elements charged with displaying said group of at least two pixels and the specific value of each pixel is stored in the capacitor CS1 of the valve element charged with displaying this pixel. According to the invention and within the framework of a sequential colour display of an image, the common values and the specific values for a given colour are transmitted sequentially to the valve alternating, for said image, the transmission of the common values for a given colour and the transmission of the specific values for the same colour or another colour. Within the framework of a monochrome display, the specific values for one and the same image are transmitted one after the other during a first part of the video frame and the common values during the other part of the frame.

Several valve architectures in accordance with the invention are proposed.

Figure 5:
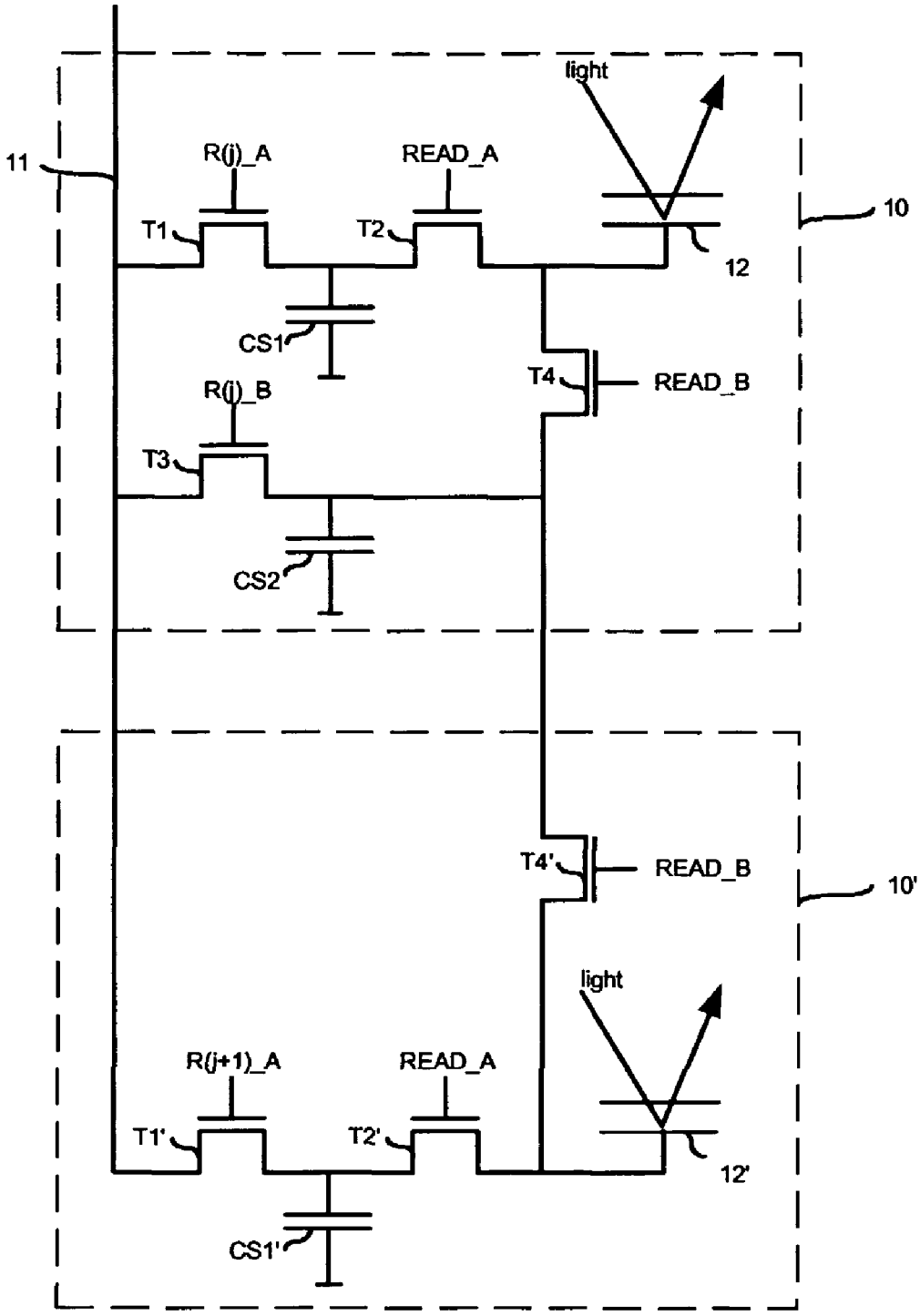
FIG. 5 represents the diagram of a pair of elements of the valve according to a first embodiment of the invention.

A first embodiment is proposed in FIG. 5.

Figure 1:
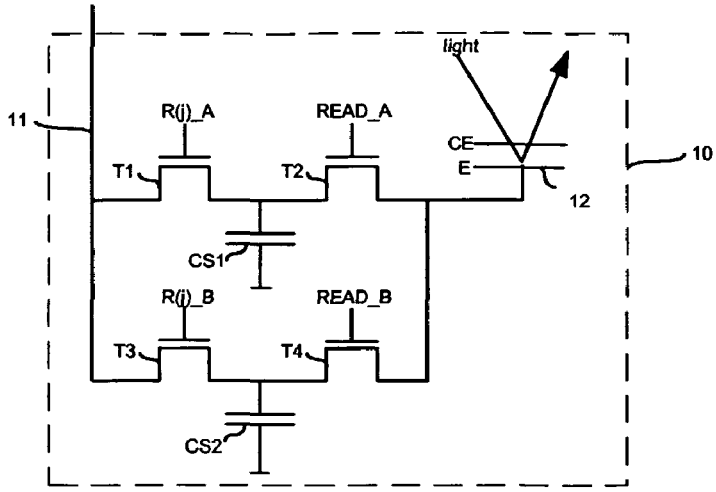
FIG.1 (prior art)
FIG. 1 represents the diagram of a valve element, with pixel memory, of the prior art.
Figure 2:
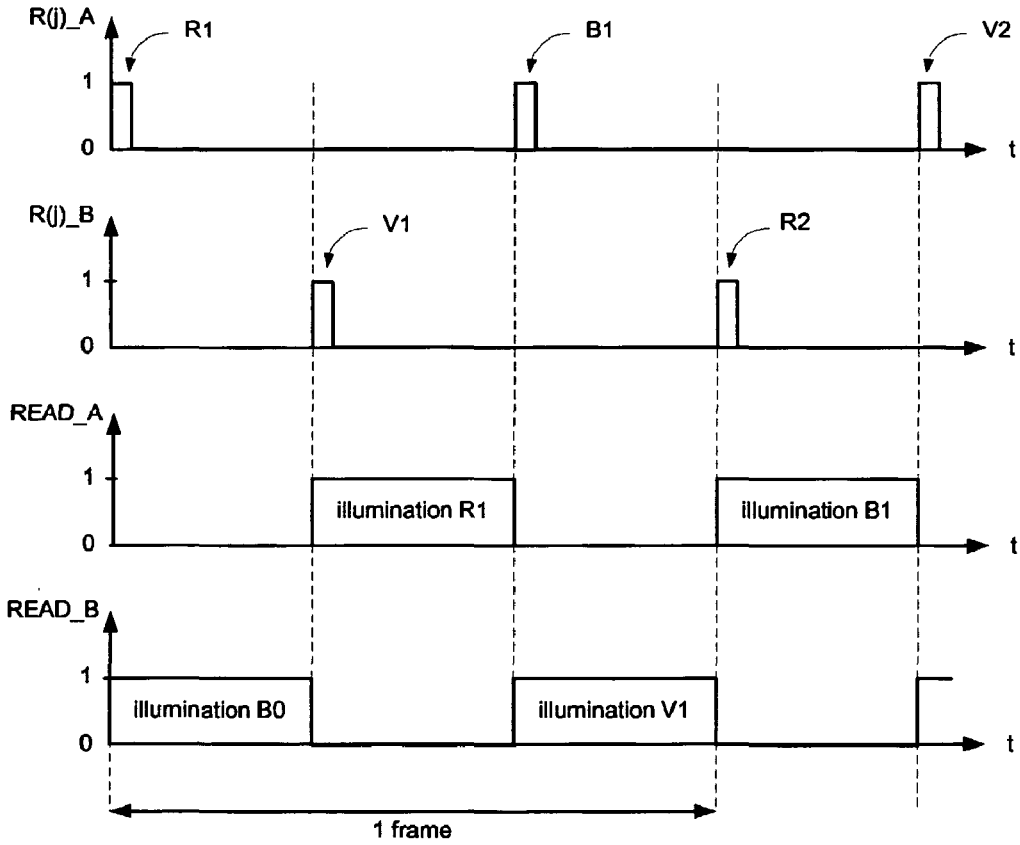
FIG.2 (prior art)
FIG. 2 represents the time charts of the drive signals of the transistors of the element of FIG. 1, FIGS. 3 and 4 illustrate two operation phases of the element of FIG. 1.
Figure 3:
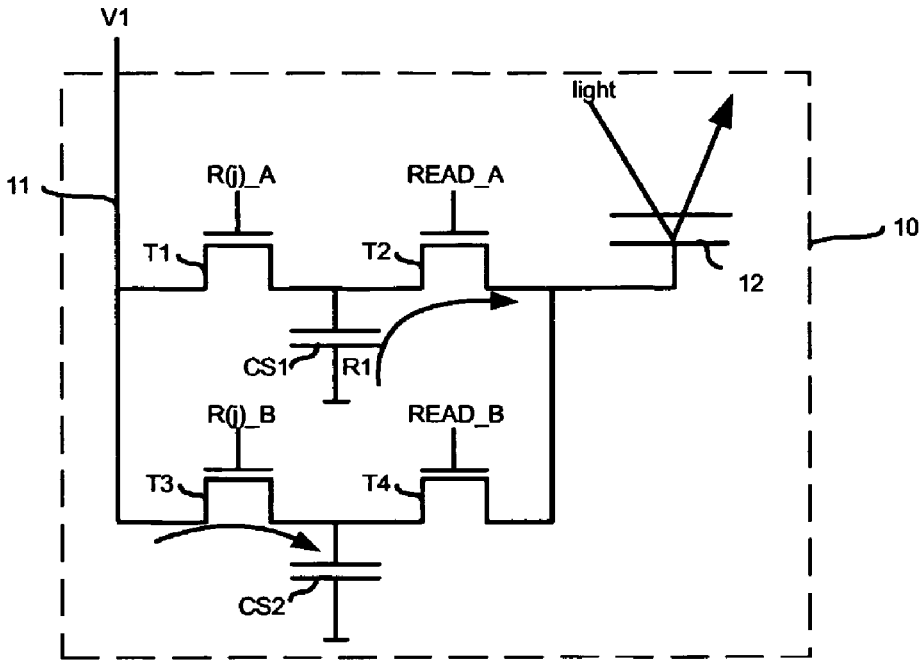
FIG.3 (prior art)
Figure 4:
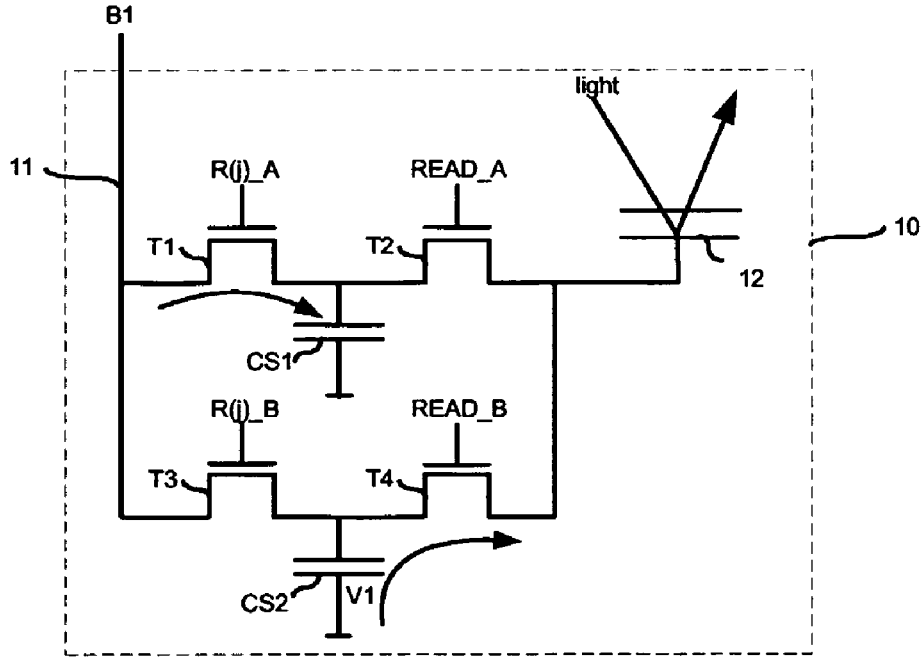
FIG.4 (prior art)

FIG. 5 represents two adjacent valve elements 10 and 10' belonging to one and the same column of elements but to two consecutive rows j and j+1 of the valve. The element 10 is equivalent to the element 10 of FIG. 1. The element 10' comprises the same components as the element 10 with the exception of the capacitor CS2 and of the transistor T3. The components T1, T2, T4, CS1 and 12 of the element 10 are designated by the references T1', T2', T4', CS1' and 12' in the element 10'. The transistor T1' is driven by the signal R(j+1)_A and the other transistors of the element 10' are driven by the same signals as in the element 10. The position of the transistor T4 (and of the corresponding transistor T4') is modified with respect to FIG. 1. The transistor T4 is mounted in series with the transistor T4' between the mirror electrodes of the liquid crystals 12 and 12' and the terminal of the capacitor CS2 connected to the transistor T3 is linked to a point situated between the two transistors T4 and T4'. The capacitor CS2 serves to store common information shared by the two elements 10 and 10'.

The particular coding to be used to operate these elements is described hereinafter. This coding is identical to that already defined in French patent FR 2 841 366. This coding has been defined so as to decrease the addressing time for the elements of the valve when the display frequency is increased. It is used, in this application, to code video information which is displayed with conventional valve elements, with or without pixel memory. The coding to be employed with the valve elements of FIG. 5 is described hereinafter through an example. Let us consider the case of a pixel P1 having, for a given colour (red, green or blue) a video level $NG_1$ equal to 150 and a pixel P2 having a video level $NG_2$ equal to 100. These two pixels are to be displayed by the two elements 10 and 10'. These two pixels therefore belong to a given column of pixels of the image and to two consecutive rows of pixels j and j+1 of the image.

The video levels $NG_1$ and $NG_2$ are decomposed into a common value VC shared by the two pixels P1 and P2 and two specific values $VS_1$ and $VS_2$, one for each pixel, such that $$NG_1 = \frac{VC + VS_1}{2} \text{ and } NG_2 = \frac{VC + VS_2}{2}.$$

possible to take $$VC = \frac{NG_1 + NG_2}{2},$$

i.e. 125 in the present case. The specific values VS1 and VS2 are then equal to 175 and 75. This example is summarized by Table 1 below.

TABLE 1

| Row number | Starting value NG; | Common value VC | Specific value VS; | Mean output value |
|---|---|---|---|---|
| j | 150 | 125 | 175 | 150 |
| J + 1 | 100 | 125 | 75 | 100 |

When, for a given pixel the specific value is displayed after the common value or vice versa, the value of grey level perceived by the human eye is the mean value, i.e. 150 for pixel P1 and 100 for pixel P2, this corresponding to the video levels $NG_1$ and $NG_2$ to be displayed. Of course, the specific value may be displayed before the common value VC or vice versa.

Figure 6:
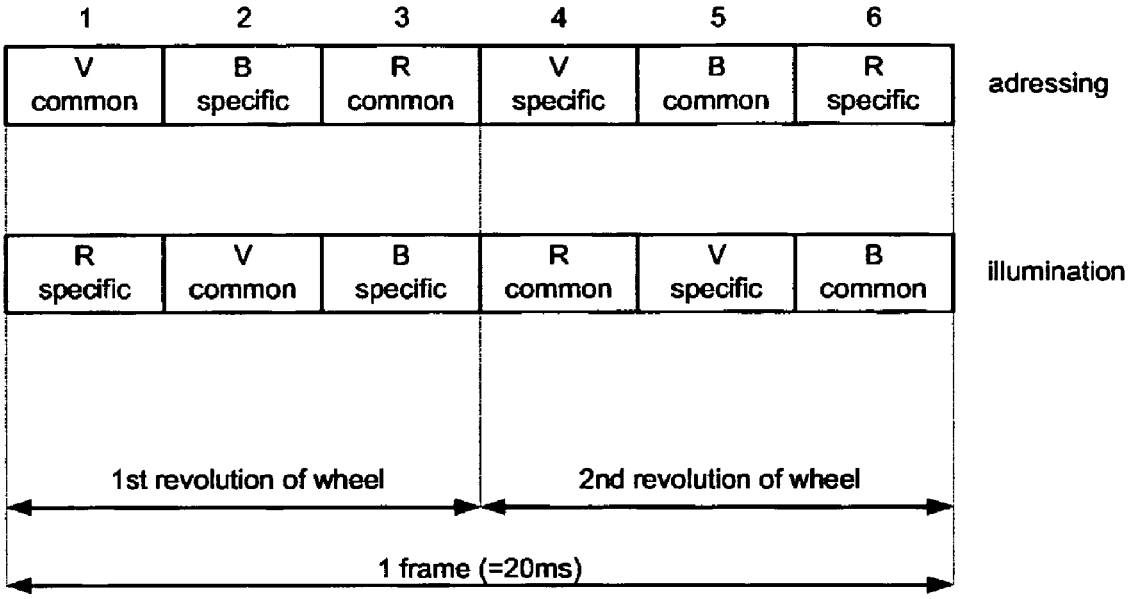
FIG. 6 illustrates the sequencing of the video information displayed by a valve according to the invention in the case of a sequential colour display.

According to the invention, the specific values of the pixels of the image for each colour are provided alternating with the common values corresponding to the valve. These values are for example transmitted as illustrated in the FIG. 6. The video frame of duration T is divided into 6 fields (of duration T/6) each assigned to a colour and numbered from 1 to 6. The common values of each colour are displayed during fields 2, 4 and 6 of the frame and the specific values during fields 1, 3 and 5, each field being assigned to a particular colour. In the example of FIG. 6, fields 1 and 4 of the frame are assigned to the green colour, fields 2 and 5 to the colour blue and fields 3 and 6 to the red colour. These values are stored, as and when they appear on the column line 11, in the capacitors CS1 and CS2 of the elements of the valve. These values are displayed with a time shift corresponding to a field with respect to the addressing, as illustrated by FIG. 6. If the projector uses a colour wheel with three colour segments—red, green, blue—the latter performs two revolutions during a frame.

If the sequencing of FIG. 6 is followed, the operation mode of the elements 10 and 10' of FIG. 5 is the following. During field 1 of the frame, a common value VC shared by the two elements for the green colour is stored in the capacitor CS2 and the specific values VS1 and VS2 stored previously in the capacitors CS1 and CS1' are displayed by the liquid crystals 12 and 12'. Accordingly, the transistor T3 is turned on when the value VC is present on the column 11 during this field. The transistors T2 and T2' are turned on during the whole of this field whereas the other transistors remain off during this field.

During field 2, the common value VC stored in the capacitor CS2 is displayed by the liquid crystals 12 and 12'. The transistors T4 and T4' are therefore conducting during the whole of this field. The specific values VS1 and VS2 for the colour blue are stored respectively in the capacitors CS1 and CS1'. The transistors T1 and T1' are therefore turned on when the values VS1 and VS2 are present on the column 11 during this field. The other transistors, T2 and T2', are off.

In the same manner, during field 3, the common value for the red colour is stored in the capacitor CS2 and the specific values for the colour blue are displayed. During field 4, the specific values for the green colour are stored in the capacitors CS1 and CS1' and the common value for the red colour is displayed. During field 5, the common value for the colour blue is stored in the capacitor CS2 and the specific values for the green colour are displayed. Finally, during field 6, the specific values for the red colour are stored in the capacitors CS1 and CS1' and the common value for the colour blue is displayed.

In this architecture where the elements of the valve are grouping together in groups of 2, the single capacitor CS2 is used to store the common values VC shared by the two elements and the two capacitors CS1 and CS1' are used to store the specific values VS1 and VS2. This architecture makes it possible to dispense with a transistor and a capacitor for each group of two elements of the valve.

Figure 7:
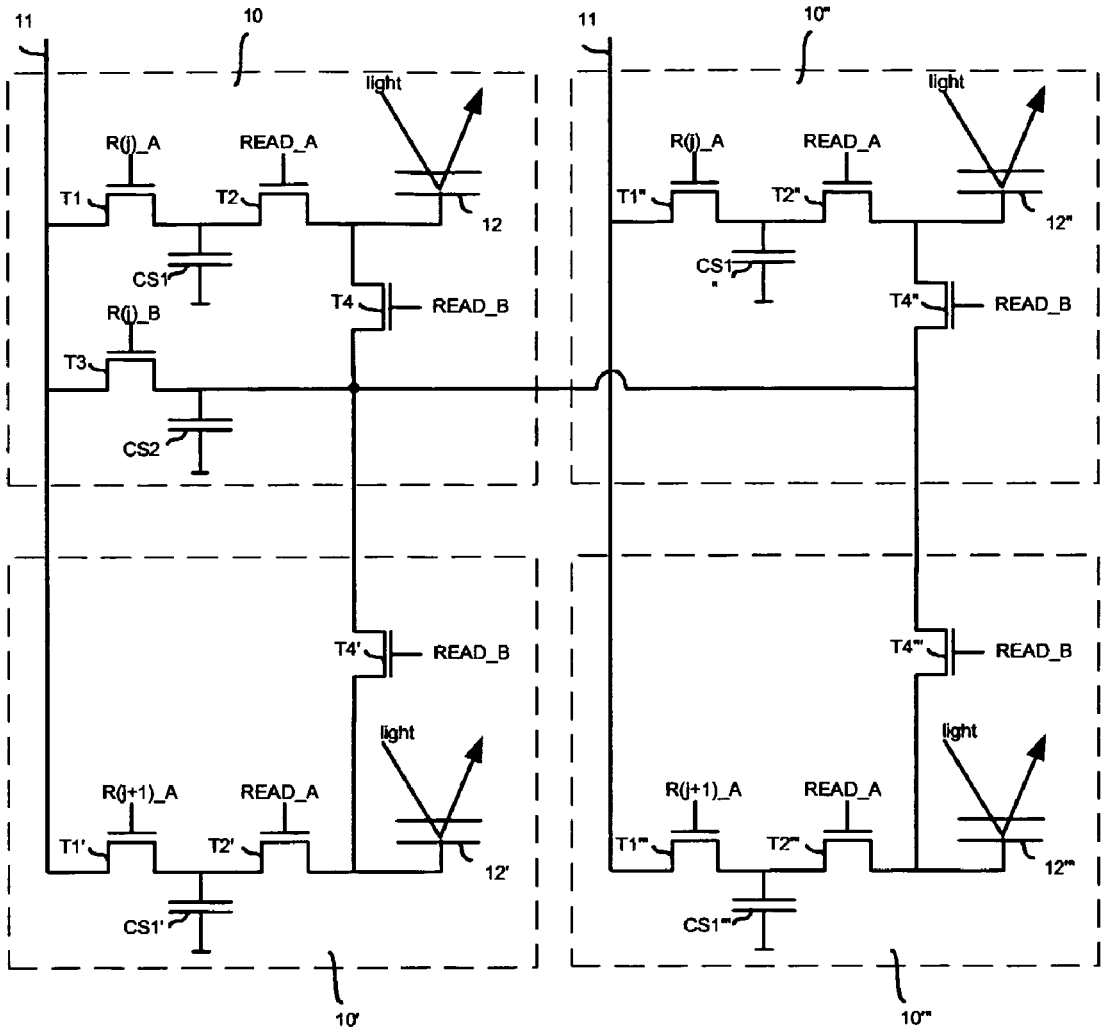
FIG. 7 represents the diagram of four valve elements according to a second embodiment of the invention.

It is also possible to save a bigger number of transistors and capacitors. It is then sufficient to use common values which are common to a larger number of elements, for example to four elements, as illustrated hereinafter. FIG. 7 shows four adjacent valve elements 10, 10', 10", 10'" in accordance with the invention. These four elements belong to two consecutive columns i and i+1 and two consecutive rows j and j+1 of the valve. The components X in the element 10 are denoted X' in the element 10', X" in the element 10" and X'" in the element 10'". The element 10 is identical to the element 10 in FIG. 5 and the elements 10', 10", 10'" are identical to the element 10' in FIG. 5. The elements 10', 10" and 10'" therefore comprise neither any capacitor CS2, nor a transistor 33. The transistors T1 and T1" are driven by the signal R(j)_A and the transistors T1" and T1'" are driven by the signal R(j+1)_A. The other transistors are driven by the same signals as those of the element 10. In this diagram, the capacitor CS2 is used in common by the four adjacent elements 10, 10', 10" and 10'". It serves to store the common values shared by these four elements.

The particular coding to be used to operate these elements is given hereinafter through an example. Let us consider the case of four image pixels P1, P2, P3 and P4 having respectively, for a given colour (red, green or blue), video levels $NG_1$=150, $NG_2$=130, $NG_3$=120 and $NG_4$=100 and to be displayed by the elements 10, 10', 10" and 10'".

The video levels $NG_1$, $NG_2$, $NG_3$ and $NG_4$ are decomposed into a common value VC shared by the four pixels and four specific values $VS_1$, $VS_2$, $VS_3$ and $VS_4$ for each of the four pixels. The common value VC is, for example, the mean value of the four input grey levels. These values are defined in Table 2 below.

TABLE 2

| (column, row) | Starting value $NG_i$ | Common value VC | Specific value $VS_i$ | Mean output value |
|---|---|---|---|---|
| (i, j) | 150 | 125 | 175 | 150 |
| (i + 1, j) | 130 | 125 | 135 | 130 |
| (i, j + 1) | 120 | 125 | 115 | 120 |
| (i + 1, j + 1) | 100 | 125 | 75 | 100 |

Thus, when, for a given pixel, the specific value and the corresponding common value are displayed sequentially, the value of grey level perceived by the human eye is the mean value, which corresponds to the video levels $NG_1$, $NG_2$, $NG_3$ and $NG_4$ which are to be displayed.

These coded values are transmitted and displayed by the elements 10, 10', 10" and 10'" as shown in FIG. 6.

In this architecture, the single capacitor CS2 is common to four valve elements. This architecture therefore makes it possible to dispense with three transistors (T3) and three capacitors (CS) for each group of four elements of the valve.

This technique may of course be extended to groups of eight or sixteen valve elements, or even more.

These architectures of valve element and the associated codings are given merely by way of example.

Figure 8:
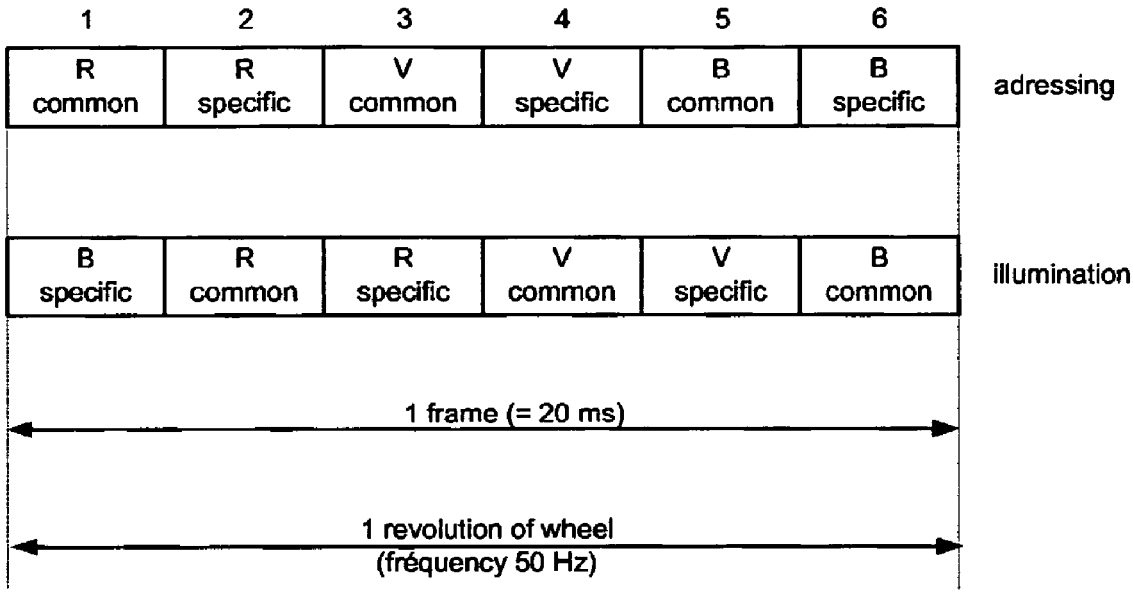
FIG. 8 represents a second sequencing of the video information displayed by a valve according to the invention in the case of a sequential colour display.
Figure 9:
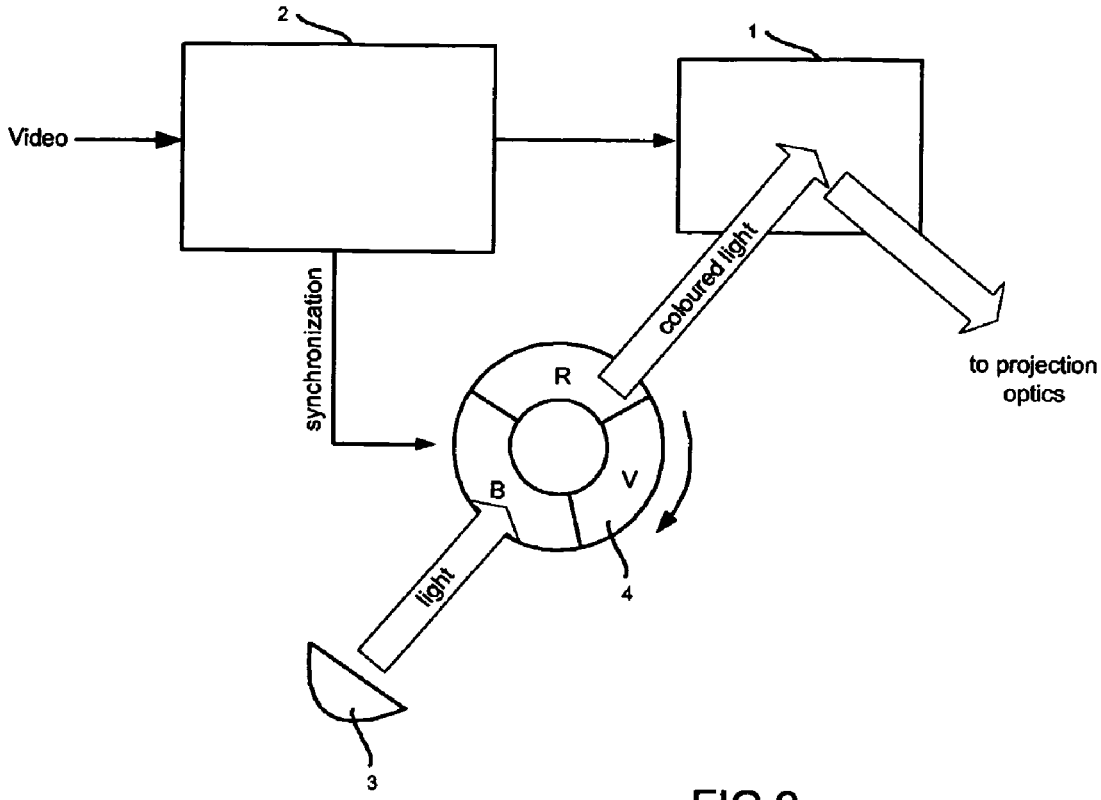
FIG. 9 represents a device in accordance with the invention.

A sequencing such as shown in FIG. 8 may also be envisaged. The common and specific values for one and the same colour are written one after the other into the elements of the valve. The drawback of this solution is, however, the presence of "colour break-up" at the transition between the common values and the specific values of each colour. An embodiment of a display device in accordance with the invention is proposed in FIG. 9. It comprises:

a valve 1 of elements arranged in rows and columns, said elements being in accordance with the diagram of FIG. 5 or 7, means 2 for coding, for each image, the video information intended to be displayed by each of the elements of the valve as a common value shared by a group of at least two adjacent elements of the valve and a specific value, as are described above, and for transmitting them to the valve 1, a light source 3 for producing white light and illuminating the valve 1, said valve reflecting or allowing through a quantity of light as a function of the specific and common values that are transmitted to it by the coding means 2, and a colour wheel 4, interposed between the light source 3 and the valve 1, comprising a colour segment for each of the colours, said wheel being synchronized with the coding means 2 so that, when specific or common values relating to a colour are applied to the mirror electrodes of the liquid crystals of the valve, the wheel segment corresponding to said colour filters the light produced by the source 3.

Of course, a light source producing coloured light directly may be provided in place of the white light source+colour wheel assembly.

In practice, the coding means 2 control the frequency of rotation of the colour wheel. To implement the sequencing of FIG. 6, the frequency of rotation of the wheel is doubled with respect to the image frequency (2 wheel revolutions at each image). In the case of FIG. 8, the frequency of rotation of the wheel is equal to the image frequency.

The light thus transmitted by the valve 1 is then redirected towards a screen by an optical device.

The invention claimed is:

1. An image display device comprising:

a valve of elements arranged in rows and columns, each of said elements comprising a liquid crystal one of whose electrodes, called the mirror electrode, is controlled by a drive circuit so as to display video information relating to at least one image, a coder for coding, for each image, the video information intended to be displayed by each of the elements of the valve, the video information being decomposed into two parts, a first part corresponding to a common value shared by a group of at least two adjacent elements of the valve and a second part corresponding to a specific value, and for transmitting them to said valve, wherein said drive circuit consists in:

for each element of the valve, a specific drive circuit coupled to the mirror electrode of the liquid crystal of said element and intended to store the specific value associated with the video information to be displayed by said element and to apply it to the mirror electrode of the liquid crystal of said element, said specific drive circuit comprising:

a first storage capacitor for storing the specific values present on a column line of the valve and intended for said element, a first switch for connecting the column line to a first end of said first storage capacitor, the other end being connected to a fixed potential, a second switch for connecting the first end of the first storage capacitor to the mirror electrode of the liquid crystal of the element; and for each group of at least two elements of the valve, a common drive circuit coupled to each element of said group and intended to store said common value associated with the video information to be displayed by said elements of the group and to apply it to the mirror electrode of the liquid crystals of the elements of said group, said common drive circuit comprising:

a single second storage capacitor for storing the common value present on the column line of the valve and intended for said group, a third switch for connecting the column line to a first end of the second storage capacitor, the other end being connected to a fixed potential, at least two fourth switches for connecting the first end of the single second storage capacitor to the at least two mirror electrodes of the liquid crystals of the elements of the group, the specific drive circuit and the common drive circuit that are coupled to one and the same group of elements controlling the liquid crystals of the elements of the group in such a way as to alternately display the specific values and the common value of the video information relating to the elements of the group for an image.

2. The device according to claim 1, wherein the display device is configured to process video information relating to at least two colours transmitted sequentially, and in that the specific drive circuit and the common drive circuit that are coupled to one and the same group of elements control the liquid crystals of the elements of the group in such a way as to alternately display the specific values of the video information relating to a colour and the common values of the video information relating to said colour or to another colour.

3. The device according to claim 2, further comprising:

a light source for producing white light and illuminating said valve of elements, said valve reflecting or allowing through a quantity of light as a function of the specific and common values that are transmitted to it by the coder, and a colour wheel, interposed between said light source and said valve, comprising a colour segment for each of said at least two colours, said wheel being synchronized with the coder so that, when specific or common values relating to a colour are applied to the mirror electrodes of the liquid crystals of the valve, the wheel segment corresponding to said colour filters the light produced by the source.

4. The device according to one of claim 1, wherein the adjacent elements of said group belong to consecutive rows and to a column of elements of the valve.

5. The device according to claim 1, wherein the adjacent elements of said group belong to consecutive rows and to consecutive columns of elements of the valve.

6. The device according to claim 1, wherein the groups of elements comprise two elements.

7. The device according to claim 1 wherein the groups of elements comprise four elements.

* * * * *